US011339509B2

(12) United States Patent
Henry et al.

(10) Patent No.: US 11,339,509 B2
(45) Date of Patent: May 24, 2022

(54) MULTI-MATERIAL INTEGRATED KNIT THERMAL PROTECTION FOR INDUSTRIAL AND VEHICLE APPLICATIONS

(71) Applicant: THE BOEING COMPANY, Chicago, IL (US)

(72) Inventors: Christopher P. Henry, Thousand Oaks, CA (US); Tiffany A. Stewart, Sherman Oaks, CA (US); Bruce Huffa, Encino, CA (US)

(73) Assignee: THE BOEING COMPANY, Chicago, IL (US)

( * ) Notice: Subject to any disclaimer, the term of this patent is extended or adjusted under 35 U.S.C. 154(b) by 167 days.

(21) Appl. No.: 16/249,433

(22) Filed: Jan. 16, 2019

(65) Prior Publication Data

US 2019/0145027 A1 May 16, 2019

Related U.S. Application Data

(62) Division of application No. 14/444,005, filed on Jul. 28, 2014, now Pat. No. 10,184,194.

(51) Int. Cl.
*D02G 3/44* (2006.01)
*D04B 1/14* (2006.01)
(Continued)

(52) U.S. Cl.
CPC ..... *D02G 3/443* (2013.01); *D04B 1/14* (2013.01); *D06C 7/02* (2013.01); *D02G 3/12* (2013.01); *D02G 3/16* (2013.01); *D10B 2101/08* (2013.01)

(58) Field of Classification Search
CPC . D06G 3/443; D06G 3/12; D06G 3/16; D04B 1/14; D06C 7/02; D10B 2101/08
(Continued)

(56) References Cited

U.S. PATENT DOCUMENTS 4,047,965 A 9/1977 Karst
4,375,779 A 3/1983 Fischer
(Continued)

FOREIGN PATENT DOCUMENTS

CN 1105717 A 7/1995
CN 100577899 1/2010
(Continued)

OTHER PUBLICATIONS

What is Annealing, published by James J. Riviello on Jun. 3, 2010 and retrieved on Jan. 16, 2021 at https://www.ceramicindustry.com/articles/90754-what-is-annealing/(Year: 2010).*
(Continued)

*Primary Examiner* — F Griffin Hall
(74) *Attorney, Agent, or Firm* — Patterson + Sheridan, LLP

(57) ABSTRACT

Knit fabrics having ceramic strands, thermal protective members formed therefrom and to their methods of construction are disclosed. Methods for fabricating thermal protection using multiple materials which may be concurrently knit are also disclosed. This unique capability to knit high temperature ceramic fibers concurrently with a load-relieving process aid, such as an inorganic or organic material (e.g., metal alloy or polymer), both small diameter wires within the knit as well as large diameter wires which provide structural support and allow for the creation of near net-shape performs at production level speed. Additionally, ceramic insulation can also be integrated concurrently to provide increased thermal protection.

23 Claims, 7 Drawing Sheets

(51) Int. Cl.
*D06C 7/02* (2006.01)
*D02G 3/12* (2006.01)
*D02G 3/16* (2006.01)

(58) Field of Classification Search
USPC ..... 66/202
See application file for complete search history.

(56) References Cited

U.S. PATENT DOCUMENTS

| | | | | |
|---|---|---|---|---|
| 4,430,851 | A | 2/1984 | Sundet | |
| 4,750,324 | A * | 6/1988 | Tochacek | D02G 3/46 57/210 |
| 4,781,039 | A | 11/1988 | Rev | |
| 5,202,070 | A | 4/1993 | Schneider | |
| 5,388,432 | A | 2/1995 | Lesage et al. | |
| 5,486,497 | A | 1/1996 | Katsuoka et al. | |
| 6,221,099 | B1 | 4/2001 | Andersen et al. | |
| 7,595,451 | B2 | 9/2009 | Kircanski et al. | |
| 8,434,333 | B2 | 5/2013 | Zhang et al. | |
| 8,505,339 | B2 | 8/2013 | Malloy et al. | |
| 10,184,194 | B2 | 1/2019 | Henry et al. | |
| 2003/0134247 | A1 | 7/2003 | Dewaegheneire | |
| 2003/0138629 | A1 | 7/2003 | Dewaegheneire | |
| 2004/0091705 | A1* | 5/2004 | Hanyon | D02G 3/442 428/373 |
| 2005/0028512 | A1 | 2/2005 | Boni | |
| 2006/0013990 | A1 | 1/2006 | Brentrup et al. | |
| 2009/0071117 | A1* | 3/2009 | Hegan, Jr. | D02G 3/443 57/230 |
| 2010/0084179 | A1* | 4/2010 | Harris | D03D 1/0041 174/350 |
| 2012/0132309 | A1* | 5/2012 | Morris | D03D 13/008 138/115 |
| 2012/0234051 | A1* | 9/2012 | Huffa | A43B 1/04 66/64 |
| 2013/0266773 | A1 | 10/2013 | Hazenberg et al. | |
| 2014/0047625 | A1* | 2/2014 | Thatcher | D06N 3/047 2/458 |
| 2015/0211154 | A1 | 7/2015 | Hightower, III | |
| 2016/0024693 | A1 | 1/2016 | Henry et al. | |
| 2016/0201260 | A1 | 7/2016 | Klein | |

FOREIGN PATENT DOCUMENTS

| | | | |
|---|---|---|---|
| CN | 102482812 | | 5/2012 |
| DE | 3622781 | | 1/1988 |
| EP | 0276164 | A1 | 7/1988 |
| EP | 0339227 | A2 | 11/1989 |
| EP | 1274959 | A1 | 1/2003 |
| EP | 1274960 | A1 | 1/2003 |
| EP | 2980289 | A1 | 2/2016 |
| GB | 2088914 | A | 6/1982 |
| JP | S6245752 | A | 2/1987 |
| JP | 2004504501 | A | 2/2004 |
| JP | 2008138312 | A | 6/2008 |
| JP | 201013762 | A | 1/2010 |
| JP | 2011255066 | A | 12/2011 |
| WO | 01/079756 | A1 | 10/2001 |
| WO | 01/079759 | A1 | 10/2001 |

OTHER PUBLICATIONS

Japanese Office Action for Application No. 2015-144677 dated Jul. 5, 2019.
Extended European Search Report for Application No. 20173796. 2-1016, dated Oct. 9, 2020.
Chinese Office Action for Application No. 201510450335.8 dated Jun. 28, 2020.
European Search Report for EP 15172902, dated Aug. 10, 2015.
Chinese Office Action dated Jun. 1, 2018 for Application No. 201510450335.8.
Chinese Office Action for Application No. 201510450335.8 dated Jul. 1, 2019.
Chinese Office Action for Application No. 201510450335.8 dated Jun. 6, 2020.
Japanese Office Action for Application No. 2015-144677 dated Jun. 25, 2019.
Japanese Office Actin for Application No. 2015-144677 dated Dec. 3, 2019.
Chinese Office Action for Application No. 201510450335.8 dated Oct. 29, 2020.

* cited by examiner

MULTI-MATERIAL INTEGRATED KNIT THERMAL PROTECTION FOR INDUSTRIAL AND VEHICLE APPLICATIONS

CROSS-REFERENCE TO RELATED APPLICATIONS

This application is a divisional of U.S. patent application Ser. No. 14/444,005, filed Jul. 28, 2014, and issued as U.S. Pat. No. 10,184,194, which is herein incorporated by reference in its entirety.

FIELD

The implementations described herein generally relate to knit fabrics and more particularly to knit fabrics having ceramic strands, thermal protective members formed therefrom and to their methods of construction.

BACKGROUND

The need for higher capability, weight efficient, and long lasting extreme environment thermal protection has necessitated the use of higher capability advanced extreme environment materials incorporating ceramic fibers. Ceramic fibers provide fabrics or textiles which have high tensile strength, high modulus of elasticity and the ability to maintain these properties at elevated temperatures. A property of ceramic fibers, however, is their somewhat brittle nature, that is, the tendency of the fibers to fracture under acute angle bends (e.g., as are present when sewing machine needles are used and/or complex geometric shapes are knit). When machine sewing thread made of ceramic fibers and twisted in the conventional manner is subjected to small radius stress, such as encountered in the sewing needle of machines or in the formation of components of complex geometries, the ceramic fiber sewing thread twisted in the conventional manner is prone to breakage. Due to this problem, tedious and labor intensive hand sewing techniques have been employed to fabricate articles made from ceramic fiber fabrics or cloths that often need to be sewn or tied with other components to increase mechanical and thermal properties tailored for specific applications.

Furthermore, these known labor intensive techniques typically have a low ability to form complex geometries, leading to wrinkling, deformations, and subsequently to degraded performance in these fiber-based products. Beyond the fabrication challenges, products produced using current techniques routinely suffer from qualification test failures, part-to-part variance and are susceptible to damage during operation as well as during routine maintenance, which in turn leads to increased cost to repair and replace.

Therefore there is a need for improved light-weight, low cost and higher temperature capable components incorporating ceramic fibers and methods of manufacturing the same.

SUMMARY

The implementations described herein generally relate to knit fabrics and more particularly to knit fabrics having ceramic strands, thermal protective members formed therefrom and to their methods of construction. According to one implementation a multi-component stranded yarn is provided. The multi-component stranded yarn comprises a continuous ceramic strand and a continuous load-relieving process aid strand. The continuous ceramic strand serves the continuous load-relieving process aid strand to form the multi-component stranded yarn. The continuous load-relieving process aid strand may be a polymeric material. The continuous load-relieving process aid strand may be a metallic material. The continuous ceramic strand may be a multifilament material and the continuous load-relieving process aid strand may be a monofilament material.

In some implementations, the multi-component stranded yarn may further comprise a metal alloy wire which is concurrently knit with the continuous ceramic strand and the continuous load-relieving process aid strand. The multi-component stranded yarn may further comprise an additional fiber component. The additional fiber component may provide at least one of the following functions: thermal insulation, reduced or increased heat transport, electrical conductivity, electrical signals, increased mechanical strength or mechanical stiffness, and increased fluid resistance. The additional fiber component may be selected from the group consisting of: ceramic, glass, mineral, thermoset polymers, thermoplastic polymers, elastomers, metal alloys, and combinations thereof.

In another implementation, a knit fabric is provided. The knit fabric comprises a continuous ceramic strand and a continuous load-relieving process aid strand. The continuous ceramic strand and the continuous load-relieving process aid strand are concurrently knit to form the knit fabric. The continuous load-relieving process aid strand may be a polymeric material. The continuous load-relieving process aid strand may be a metallic material. The continuous ceramic strand may serve the continuous load-relieving process aid strand to form a multi-component stranded yarn. The load-relieving process aid strand may be removed after knitting. The knit fabric can be laid up into a preform or fit on a mandrel.

In some implementations, a second fiber may be concurrently knit with the multi-component stranded yarn. The continuous load-relieving process aid strand may be a polymeric material and the second fiber may be a metallic material.

In some implementations, the knit fabric may further comprise one or more additional fiber components. The one or more additional fiber components are selected from the group consisting of: ceramic, glass, mineral, thermoset polymers, thermoplastic polymers, elastomers, metal alloys, and combinations thereof.

In some implementations, the knit fabric may further comprise one or more filler materials. The one or more filler materials may be fluid resistant. The one or more filler materials may be heat resistant. The continuous ceramic strand and the second fiber can comprise the same or different knit stitches. The continuous ceramic strand and the second fiber may be concurrently knit in a single layer. The continuous ceramic strand and the second fiber may be knit as regions. The continuous ceramic strand and the second fiber component may be inlaid in warp and/or weft directions.

In some implementations, the knit fabric may be knit as multiple layers. The multiple layers may have intermittent stitch or inlaid connectivity between layers. The multiple layers may contain pockets or channels. The pockets or channels may contain electrical wiring, sensors or electrical functionality. The pockets or channels may contain filler material inserts. The multiple layers may be heat resistant. The filler material inserts may be heat resistant.

In yet another implementation, a method for knitting a ceramic is provided. The method comprises simultaneously feeding a continuous ceramic strand and a continuous load-relieving process aid strand into a knitting machine through a single material feeder to form a bi-component yarn. The method may further comprise wrapping the continuous ceramic strand around the continuous process aid strand prior to simultaneously feeding the continuous ceramic strand and the continuous load-relieving process aid strand into the knitting machine. The method may further comprise simultaneously feeding the bi-component yarn and a metal alloy wire through a second material feeder to form a knit fabric. The method may further comprise heating the knit fabric to a first temperature to remove the load-relieving process aid. The method may further comprise heating the knit fabric to a second temperature greater than the first temperature to anneal the ceramic strand. The method may further comprise removing the continuous load-relieving process aid strand from the knit fabric. The process aid may be removed by exposure to a solvent, heat or light to remove the process aid.

The features, functions, and advantages that have been discussed can be achieved independently in various implementations or may be combined in yet other implementations, further details of which can be seen with reference to the following description and drawings.

BRIEF DESCRIPTION OF ILLUSTRATIONS

So that the manner in which the above-recited features of the present disclosure can be understood in detail, a more particular description of the disclosure briefly summarized above may be had by reference to implementations, some of which are illustrated in the appended drawings. It is to be noted, however, that the appended drawings illustrate only typical implementations of this disclosure and are therefore not to be considered limiting of its scope, for the disclosure may admit to other equally effective implementations.

To facilitate understanding, identical reference numerals have been used, wherever possible, to designate identical elements that are common to the Figures. Additionally, elements of one implementation may be advantageously adapted for utilization in other implementations described herein.

DETAILED DESCRIPTION

Figure 1:
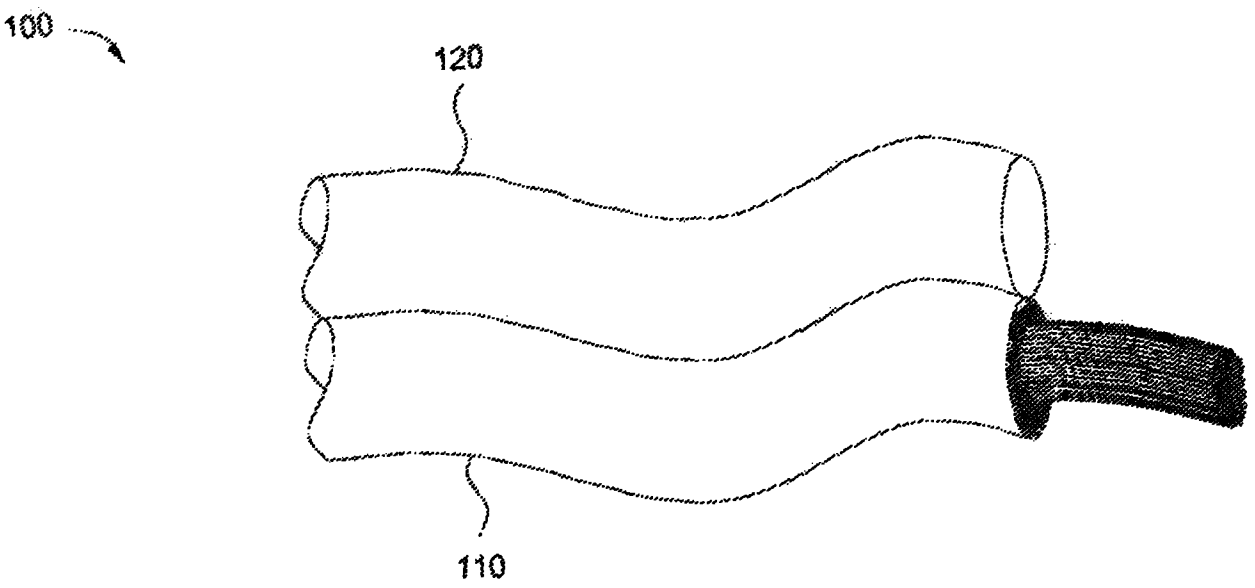
FIG. 1 is an enlarged partial perspective view of a multi-component stranded yarn including a continuous ceramic strand and a continuous load-relieving process aid strand prior to processing according to implementations described herein.

The following disclosure describes knit fabrics and more particularly knit fabrics having ceramic strands, thermal protective members formed therefrom and to their methods of construction. Certain details are set forth in the following description and in FIGS. 1-7 to provide a thorough understanding of various implementations of the disclosure. Other details describing well-known structures and systems often associated with knit fabrics and forming knit fabrics are not set forth in the following disclosure to avoid unnecessarily obscuring the description of the various implementations.

Many of the details, dimensions, angles and other features shown in the Figures are merely illustrative of particular implementations. Accordingly, other implementations can have other details, components, dimensions, angles and features without departing from the spirit or scope of the present disclosure. In addition, further implementations of the disclosure can be practiced without several of the details described below.

Prior to the implementations described herein, it was not feasible to knit ceramic fibers into fabric, products having complex geometries, or near net shape parts because current commercially available yarns break during the knitting process due to the radius of curvature the yarn encounters during the commercial knitting process. Current knitting techniques have attempted to address the brittleness of ceramic fibers by wrapping the ceramic fiber with a polymeric material to provide additional strength; however, these wrapped ceramic fibers still suffer from breakage when exposed to the small radius stresses present in most commercial knitting machines. Thus current knitting techniques fail to address the fundamental issue of load bearing. The implementations described herein prevent breakage of ceramic fibers during knitting by providing a load-relieving process aid for the ceramic fiber to alleviate overstress of the ceramic fibers. The positioning of the process aid takes the load during the knitting process and preferentially de-tensions the ceramic fiber as the fibers go around the small radius curvature present in most commercial knitting machines. Inclusion of the load-relieving process strand increases the ability of the ceramic fibers to withstand the small radius stress often encountered in commercial knitting machines which allows for the formation of complex near net-shape performs at production level speed.

Some implementations described herein relate to methods for fabricating thermal protection using multiple materials which may be concurrently knit with commercially available knitting machines. This unique capability to knit high temperature ceramic fibers concurrently with a load-relieving process aid, such as an inorganic or organic material (e.g., metal alloy or polymer), both small diameter wire (e.g., from about 50 micrometers to about 300 micrometers) within the knit as well as large diameter wire (e.g., from about 300 micrometers to about 1,000 micrometers). The load-relieving process aid provides structural support and de-tensions the ceramic fiber as the ceramic fiber is exposed the stresses of the small radius curvature present in commercial knitting machines. Thus allowing for the creation of near net-shape performs comprising ceramic fibers at production level speed. Additionally, ceramic insulation can also be integrated concurrently to provide increased thermal protection.

Some implementations described herein further include lighter-weight, efficient, and low cost thermal protection that permits higher operational temperatures. Common techniques concurrently used for high temperature fiber performs include woven fabrics that must be integrated by hand with other components to increase mechanical and thermal properties tailored for specific applications. These techniques typically have a low ability to perform complex geometries leading to wrinkling, deformations, and subsequently to degraded performance at critical regions. Beyond the fabrication challenges, current solutions routinely suffer from qualification test failures, part-to-part variance, and are susceptible to damage during operation as well as during routine maintenance, which in turn leads to increased cost to repair and replace. Multi-material integrated knit thermal protection solves many of these fabrication issues by creating near net-shape performs with consistent material properties.

In addition, some implementations described herein also include a fabrication process for knit thermal protection materials using a commercially available knitting machine. Unlike previous work, some implementations described herein include multiple materials being concurrently knit in a single layer. The materials and knit parameters may be varied in order to produce a tailorable part for a specific application. Some implementations described herein generally differ from previous techniques with at least one of the following advantages: enables higher operating temperature engines; reduces certification effort and time; and reduces process fabrication and maintenance costs.

In some implementations described herein, multiple materials (e.g., ceramic fibers and alloy wires) are concurrently knit in a single knit layer. Concurrently knitting in a single layer may save weight, fabrication and assembly labor for registration of layers. In some implementations, the knit surrounds an inlaid larger diameter wire which serves to resist an applied mechanical force.

The implementations described herein are potentially useful across a broad range of products, including many industrial products and aero-based owner products (subsonic, supersonic and space), which would significantly benefit from lighter-weight, low cost, and higher temperature capable shaped components. These components include but are not limited to a variety of soft goods such as, for example, thermally resistant seals, gaskets, expansion joints, blankets, wiring insulation, tubing/ductwork, piping sleeves, firewalls, insulation for thrust reversers, engine struts and composite fan cowls. These components also include but are not limited to hard goods such as exhaust and engine coverings, shields and tiles.

The materials and methods for fabricating knit thermal protection described herein may be performed using commercially-available knitting machines. In some implementations, in order to prevent breakage of the ceramic fiber, a sacrificial monofilament may be used as a knit processing aid which may be removed after the component is knit. Additionally, in some implementations, a metal alloy component may be "plated" with the ceramic yarn into the desired knit fabric.

The materials described herein can also be knit into net-shapes and fabrics containing spatially differentiated zones, both simple and complex, directly off the machine through conventional bind off and other apparel knitting techniques. Exemplary net-shapes include simple box-shaped components, complex curvature variable diameter tubular shapes, and geometric tubular shapes.

The term "filament" as used herein refers to a fiber that comes in continuous or near continuous length. The term "filament" is meant to include monofilaments and/or multi-filament, with specific reference being given to the type of filament, as necessary.

The term "flexible" as used herein means having a sufficient pliability to withstand small radius bends, or small loop formation without fracturing, as exemplified by not having the ability to be used in stitch bonding or knitting machines without substantial breakage.

The term "heat fugitive" as used herein means volatizes, burns or decomposes upon heating.

The term "strand" as used herein means a plurality of aligned, aggregated fibers or filaments.

The term "yarn" as used herein refers to a continuous strand or a plurality of strands spun from a group of natural or synthetic fibers, filaments or other materials which can be twisted, untwisted or laid together.

Referring in more detail to the drawings, FIG. 1 is an enlarged partial perspective view of a multi-component stranded yarn 100 including a continuous ceramic strand 110 and a continuous load-relieving process aid strand 120 prior to processing according to implementations described herein. The continuous load-relieving process aid strand 120 is typically under tension during the knitting process while reducing the amount of tension that the continuous ceramic strand is subjected to during the knitting process. As depicted in FIG. 1, the multi-component stranded yarn 100 is a bi-component stranded yarn.

The continuous ceramic strand 110 may be a high temperature resistant ceramic strand. The continuous ceramic strand 110 is typically resistant to temperatures greater than 500 degrees Celsius (e.g., greater than 1200 degrees Celsius). The continuous ceramic strand 110 typically comprises multi-filament inorganic fibers. The continuous ceramic strand 110 may comprise individual ceramic filaments whose diameter is about 15 micrometers or less (e.g., 12 micrometers or less; a range from about 1 micron to about 12 micrometers) and with the yarn having a denier in the range of about 50 to 2,400 (e.g., a range from about 200 to about 1,800; a range from about 400 to about 1,000). The continuous ceramic strand 110 can be sufficiently brittle but not break in a small radius bend of less than 0.07 inches (0.18 cm). In some implementations, a continuous carbon-fiber strand may be used in place of the continuous ceramic strand 110.

Exemplary inorganic fibers include inorganic fibers such as fused silica fiber (e.g., Astroquartz® continuous fused silica fibers) or non-vitreous fibers such as graphite fiber, silicon carbide fiber (e.g., NICALON™ ceramic fiber available from Nippon Carbon Co., Ltd. of Japan) or fibers of ceramic metal oxide(s) (which can be combined with non-metal oxides, e.g., $SiO_2$) such as thoria-silica-metal (III) oxide fibers, zirconia-silica fibers, alumina-silica fibers, alumina-chromia-metal (IV) oxide fiber, titania fibers, and alumina-boria-silica fibers (e.g., 3M™ Nextel™ 312 continuous ceramic oxide fibers). These inorganic fibers may be used for high temperature applications. In implementations where the continuous ceramic strand 110 comprises alumina-boria-silica yarns, the alumina-boria-silica may comprise individual ceramic filaments whose diameter is about 8 micrometers or less and with the yarn having a denier in the range of about 200 to 1200.

The continuous load-relieving process aid strand 120 may be a monofilament or multi-filament strand. The continuous load-relieving process aid strand 120 may comprise organic (e.g., polymeric), inorganic materials (e.g., metal or metal alloy) or combinations thereof. In some implementations, the continuous load-relieving process aid strand 120 is flexible. In some implementations, the continuous load-relieving process aid strand 120 has a high tensile strength and a high modulus of elasticity. In implementations where the process aid strand 120 is a monofilament, the process aid strand 120 may have a diameter from about 100 micrometers to about 625 micrometers (e.g., from about 150 micrometers to about 250 micrometers; from about 175 micrometers to about 225 micrometers). In implementations where the process aid strand 120 is a multifilament, the individual filaments of the multifilament may each have a diameter from about 10 micrometers to about 50 micrometers (e.g., from about 20 micrometers to about 40 micrometers).

Depending on the application, the process aid strand 120, whether multifilament or monofilaments, can be formed from, by way of example and without limitation from polyester, polyamide (e.g., Nylon 6,6), polyvinyl acetate, polyvinyl alcohol, polypropylene, polyethylene, acrylic, cotton, rayon, and fire retardant (FR) versions of all the aforementioned materials when extremely high temperature ratings are not required. If higher temperature ratings are desired along with FR capabilities, then the process aid strand 120 could be constructed from, by way of example and without limitation, materials including meta-Aramid fibers (sold under names Nomex®, Conex®, for example), para-Aramid (sold under the tradenames Kevlar®, Twaron®, for example), polyetherimide (PEI) (sold under the tradename Ultem®, for example), polyphenylene sulfide (PPS), liquid crystal thermoset (LCT) resins, polytetrafluoroethylene (PTFE), and polyether ether ketone (PEEK). When even higher temperature ratings are desired along with FR capabilities, the process aid strand 120 can include mineral yarns such as fiberglass, basalt, silica and ceramic, for example. Aromatic polyamide yarns and polyester yarns are illustrative yarns that can be used as the continuous load-relieving process aid strand 120.

In some implementations, the process aid strand 120, when made of organic fibers, may be heat fugitive, i.e., the organic fibers are volatized or burned away when the knit article is exposed to a high temperatures (e.g., 300 degrees Celsius or higher; 500 degrees Celsius or higher). In some implementations, the process aid strand 120, when made of organic fibers, may be chemical fugitive, i.e., the organic fibers are dissolved or decomposed when the knit article is exposed to a chemical treatment.

In some implementations, the process aid strand 120 is a metal or metal alloy. In some implementations for corrosion resistant applications, the continuous load-relieving process aid strand 120 may comprise continuous strands of nickel-chromium based alloys (e.g., INCONEL® alloy 718), aluminum, stainless steel, such as a low carbon stainless steel, for example, SS316L, which has high corrosion resistance properties. Other conductive continuous strands of metal wire may be used, such as, for example, copper, tin or nickel plated copper, and other metal alloys. These conductive continuous strands may be used in conductive applications. In implementations where the process aid strand 120 is a multifilament, the individual filaments of the multifilament may each have a diameter from about 50 micrometers to about 300 micrometers (e.g., from about 100 micrometers to about 200 micrometers).

The continuous load-relieving process aid strand 120 and the continuous ceramic strand 110 may both be drawn into a knitting system through a single material feeder together or "plated" in the knitting system through two material feeders to create the desired knit fabric with the continuous load-relieving process aid strand 120 substantially exposed on one face of the fabric and the continuous ceramic strand 110 substantially exposed on the opposing face of the fabric.

Figure 2:
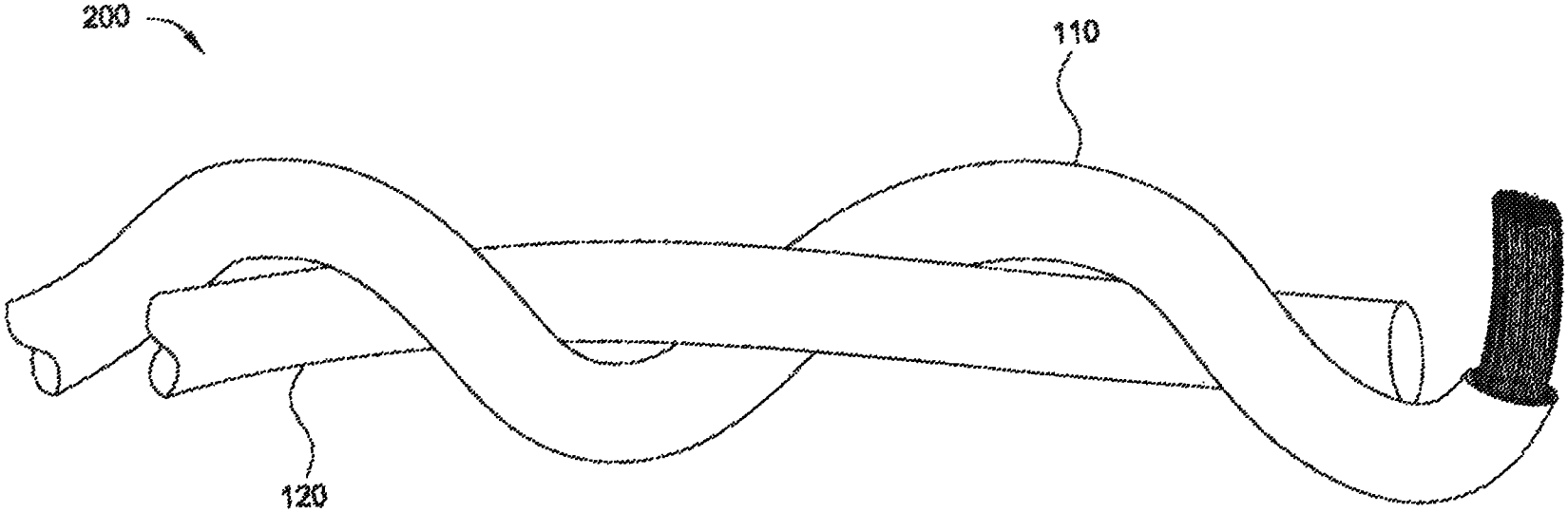
FIG. 2 is an enlarged partial perspective view of a multi-component stranded yarn including a continuous ceramic strand wrapped around a continuous load-relieving process aid strand according to implementations described herein.

FIG. 2 is an enlarged partial perspective view of a multi-component stranded yarn 200 including the continuous ceramic strand 110 served (wrapped) around the continuous load-relieving process aid strand 120 according to implementations described herein. The continuous load-relieving process aid strand 120 is typically under tension during the knitting process while reducing the amount of tension that the continuous ceramic strand 110 is subjected to during the knitting process. This reduction in tension typically leads to reduced breakage of the continuous ceramic strand 110.

The continuous ceramic strand 110 is typically wrapped around the continuous load-relieving process aid strand 120 prior to being drawn into the knitting system. The continuous ceramic strand 110 wrapped around the continuous load-relieving process aid strand 120 may be drawn into the knitting system through a single material feeder to create the desired knit fabric.

A serving process may be used to apply the continuous ceramic strand 110 to the continuous load-relieving process aid strand 120. Although any device which provides covering to the continuous load-relieving process aid strand 120, as by wrapping or braiding the continuous ceramic strand 110 around the continuous load-relieving process aid 120, could be used, such as a braiding machine or a serving/overwrapping machine. The continuous ceramic strand 110 can be wrapped on the process aid strand 120 in a number of different ways, i.e. the continuous ceramic strand 110 can be wrapped around the process aid strand 120 in both directions (double-served), or it can be wrapped around the process aid strand 120 in one direction only (single served). Also the number of wraps per unit of length can be varied. For example, in one implementation, 0.3 to 3 wraps per inch (e.g., 0.1 to 1 wraps per cm) are used.

Figure 3:
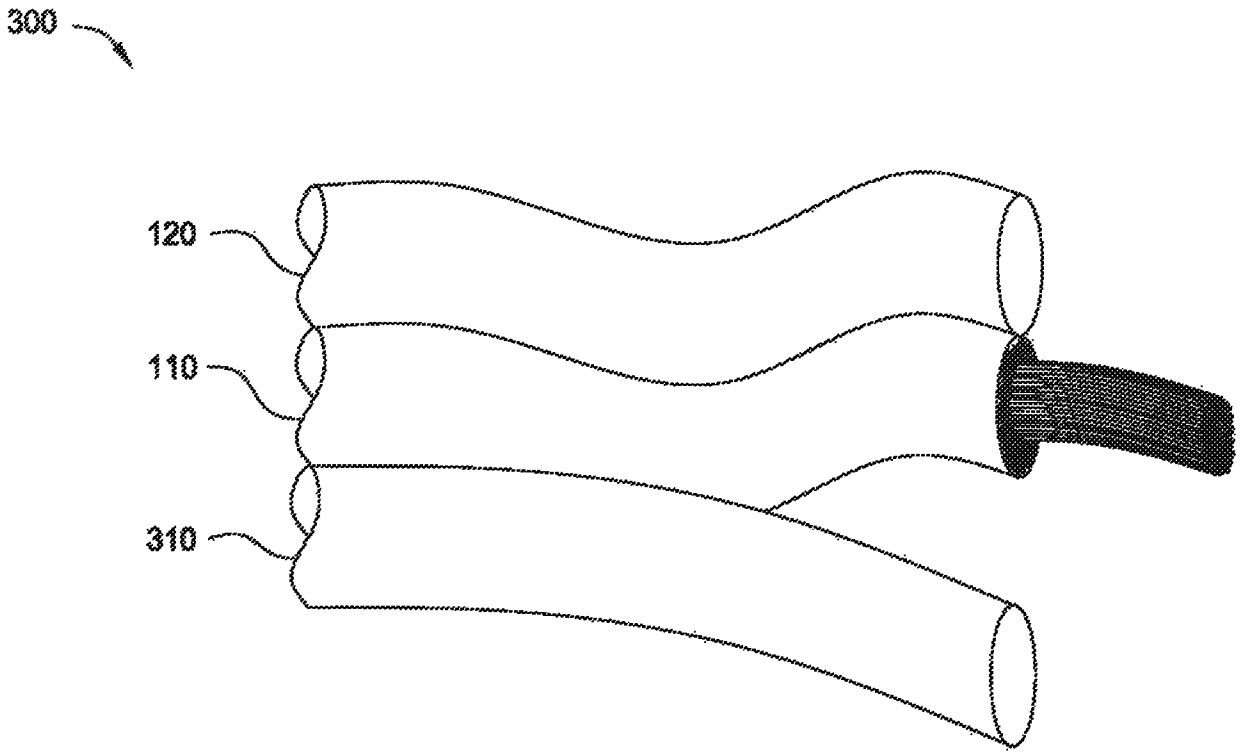
FIG. 3 is an enlarged partial perspective view of a multi-component stranded yarn including a continuous ceramic strand, a continuous load-relieving process aid strand and a metal alloy wire prior to processing according to implementations described herein.

FIG. 3 is an enlarged partial perspective view of a multi-component stranded yarn 300 including the continuous ceramic strand 110, the continuous load-relieving process aid strand 120 and a metal wire 310 prior to processing according to implementations described herein. As depicted in FIG. 3, the multi-component stranded yarn 300 is a tri-component stranded yarn. The metal wire 310 provides additional support to the continuous ceramic strand 110 during the knitting process. The process aid strand 120 may be a polymeric monofilament as previously described herein. The process aid strand 120 and the continuous ceramic strand 110 may be both drawn into the knitting system through a single material feeder and "plated" together with the metal wire 310 which is drawn into the system through a second material feeder to create the desired knit fabric.

Similar to the previously described metal alloy process aid 120, the metal wire 310 may comprise continuous strands of nickel-chromium based alloys (e.g., INCONEL® alloy 718), aluminum, stainless steel, such as a low carbon stainless steel, for example, SS316L, which has high corrosion resistance properties, however, other conductive continuous strands of metal wire could be used, such as, copper, tin or nickel plated copper, and other metal alloys, for example.

In implementations where the process aid 120 is heat fugitive (e.g., removed via a heat cleaning process), the metal wire 310 is typically selected such that it will withstand the heat cleaning process. In implementations where the metal wire 310 is a monofilament, the process aid strand may have a diameter from about 100 micrometers to about 625 micrometers (e.g., from about 150 micrometers to about 250 micrometers). In implementations where the metal wire 310 is a multifilament, the individual filaments of the multifilament may each have a diameter from about 10 micrometers to about 50 micrometers.

Figure 4:
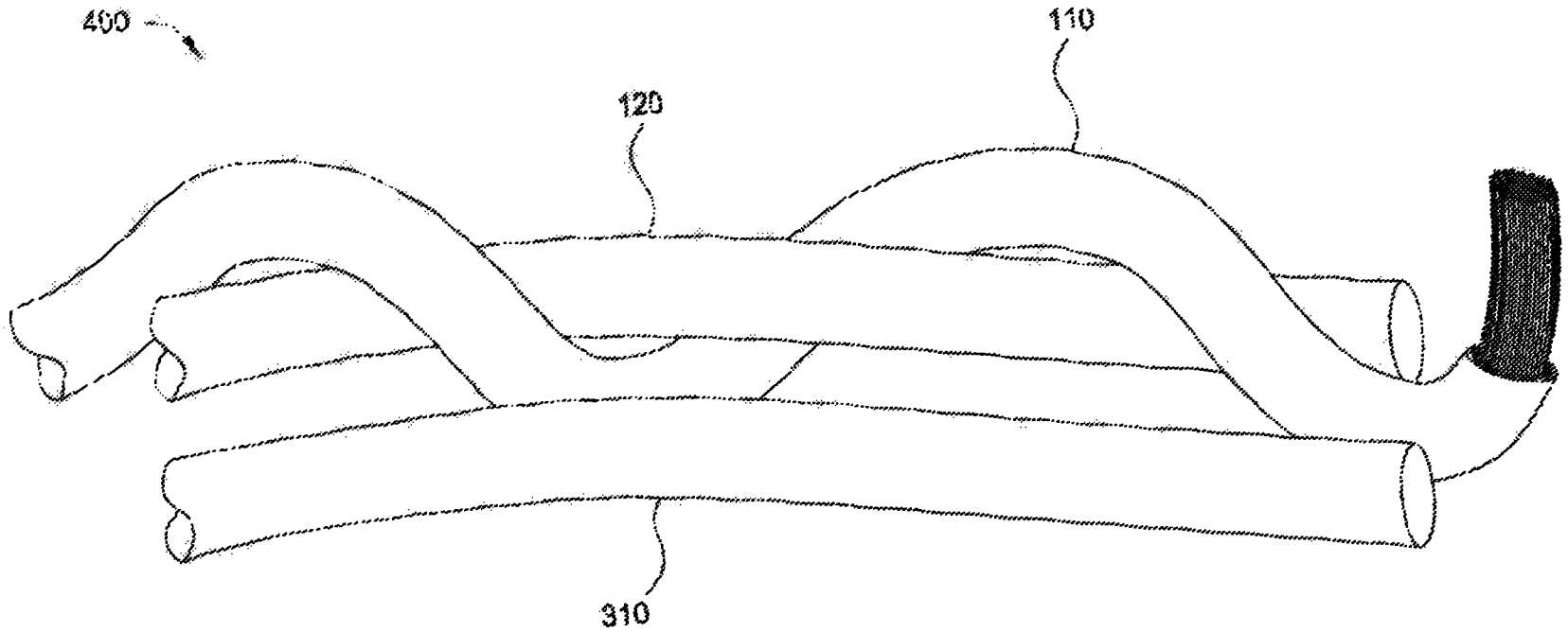
FIG. 4 is an enlarged partial perspective view of a multi-component stranded yarn including a continuous ceramic strand wrapped around a continuous load-relieving process aid strand and a metal alloy wire according to implementations described herein.

FIG. 4 is an enlarged partial perspective view of another multi-component stranded yarn 400 including the continuous ceramic strand 110 served around the continuous load-relieving process aid strand 120 and the metal wire 310 according to implementations described herein. As depicted in FIG. 4, the multi-component stranded yarn 400 is a tri-component stranded yarn. The process aid strand 120 is a polymeric monofilament as previously described herein. The continuous ceramic strand 110 served around the process aid strand 120 are both drawn into the knitting system through a single material feeder and "plated" together with the metal wire 310 which is drawn into the system through a second material feeder to create the desired knit fabric.

Figure 5:
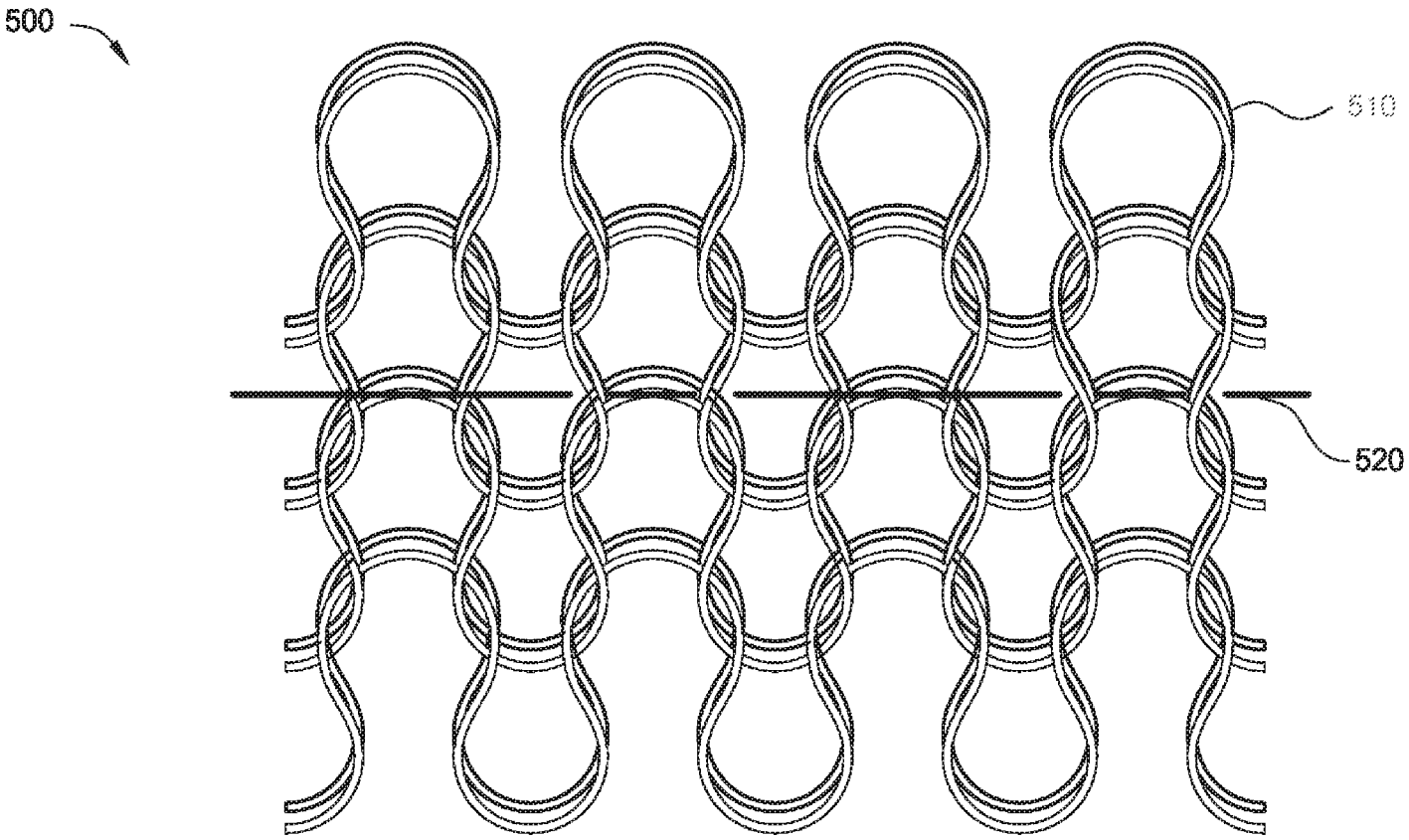
FIG. 5 is an enlarged perspective view of one example of a knit fabric that includes a multi-component yarn and a fabric integrated inlay according to implementations described herein.

FIG. 5 is an enlarged perspective view of one example of a multi-component yarn 510 in a knit fabric 500 that could include warp or weft inlay yarns 520 according to implementations described herein. The knit fabric with periodically interwoven inlay 520 provides additional stiffness and strength to the knit fabric 500. The fabric integrated inlay 520 may be composed of any of the aforementioned metal or ceramic materials. The fabric integrated inlay 520 typically comprises a larger diameter material (e.g., from about 300 micrometers to about 3,000 micrometers) that either cannot be knit or is difficult to knit due to the diameter of the fabric integrated inlay and the gauge of the knitting machine. However, it should be understood that the diameter of the material that can be knit is dependent upon the gauge of the knitting machine and as a result different knitting machines can knit materials of different diameters. The fabric integrated inlay 520 may be placed in the knit fabric 500 by laying the fabric integrated inlay 520 in between opposing stitches for an interwoven effect. The multi-component yarn 510 may be any of the multi-component yarns depicted in FIGS. 1-4. Although FIG. 5 depicts a jersey knit fabric zone, it should be noted that the depiction of a jersey knit fabric zone is only exemplary and that the implementations described herein are not limited to jersey knit fabrics. Any suitable knit stitch and density of stitch can be used to construct the knit fabrics described herein. For example, any combination of knit stitches, e.g., jersey, interlock, rib forming stitches, or otherwise may be used.

In addition to the continuous ceramic strand, the knit fabric may further comprise a second fiber component. The second fiber component may be selected from the group consisting of: ceramics, glass, minerals, thermoset polymers, thermoplastic polymers, elastomers, metal alloys, and combinations thereof. The continuous ceramic strand and the second fiber component can comprise the same or different knit stitches. The continuous ceramic strand and the second fiber component may be concurrently knit in a single layer. The continuous ceramic strand and the second fiber can comprise the same knit stitches or different knit stitches. The continuous ceramic strand and the second fiber may be knit as integrated separate regions of the final knit product. Knitting as integrated separate regions may reduce the need for cutting and sewing to change the characteristics of that region. The knit integrated regions may have continuous fiber interfaces, whereas the cut and sewn interfaces do not have continuous interfaces making integration of the previous functionalities difficult to implement (e.g., electrical conductivity). The continuous ceramic strand and the second fiber component may each be inlaid in warp and/or weft directions.

The knit fabrics described herein may be knit into multiple layers. Knitting the knit fabrics described herein into multiple layers allows for combination with fabrics having different properties (e.g., (structural, thermal or electric) while maintaining peripheral connectivity or registration within/between the layers of the overall fabric. The multiple layers may have intermittent stitch or inlaid connectivity between the layers. This intermittent stitch or inlaid connectivity between the layers may allow for the tailoring of functional properties/connectivity over shorter length scales (e.g., <0.25"). For example, with two knit outer layers with an interconnecting layer between the two outer layers. The multiple layers may contain pockets or channels. The pockets or channels may contain electrical wiring, sensors or other electrical functionality. The pockets or channels may contain one or more filler materials.

The one or more filler materials may be selected to enhance the desired properties of the final knit product. The one or more filler materials may be fluid resistant. The one or more filler materials may be heat resistant. Exemplary filler material include common filler particles such as carbon black, mica, clays such as e.g., montmorillonite clays, silicates, glass fiber, carbon fiber, and the like, and combinations thereof.

Figure 6:
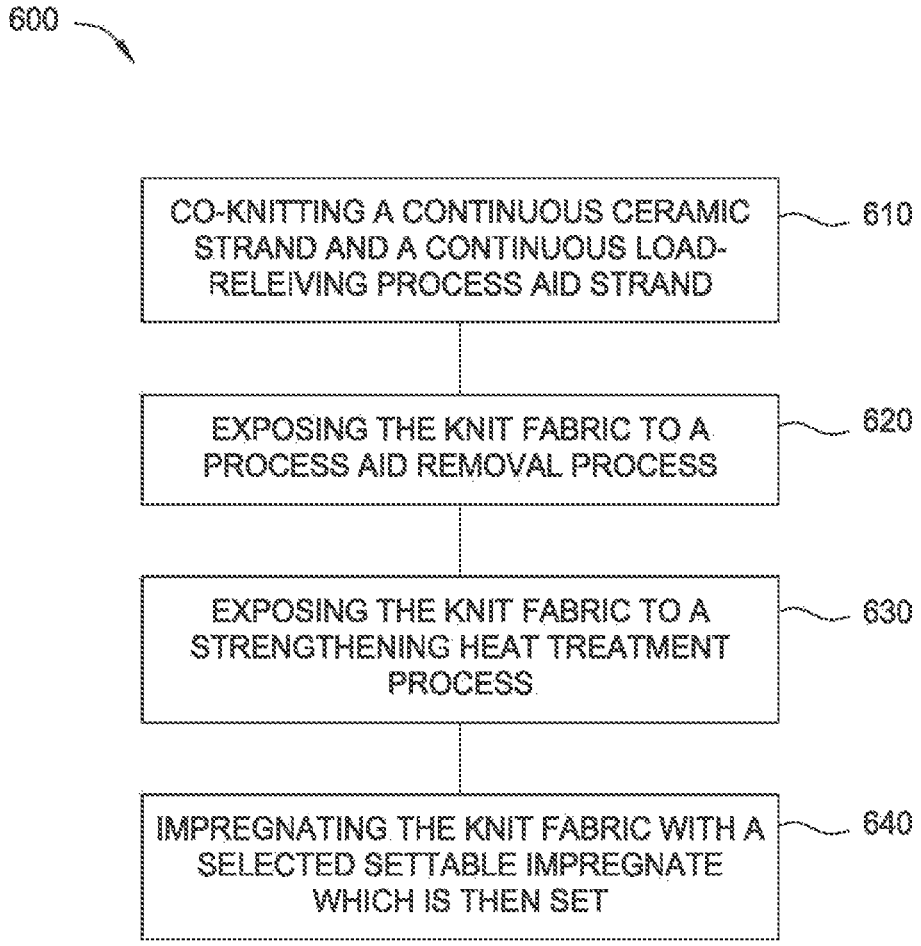
FIG. 6 is a process flow diagram for forming a knit material according to implementations described herein.

FIG. 6 is a process flow diagram 600 for forming a knit product according to implementations described herein. At block 610, a continuous ceramic strand and a continuous load-relieving process aid strand are concurrently knit to form a knit fabric. The continuous ceramic strand and the continuous load-relieving process aid strand may be as previously described above. The strands may be concurrently knit on the knitting machine 700 depicted in FIG. 7 or any other suitable knitting machine. The continuous ceramic strand and the continuous load-relieving strand may be simultaneously fed into a knitting machine through a single material feeder to form a multi-component yarn. In implementations where the continuous ceramic strand is wrapped around the continuous load-relieving process aid strand (e.g., as depicted in FIG. 2 and FIG. 4), the continuous ceramic strand may be wrapped around the continuous process aid strand prior to simultaneously feeding the continuous ceramic strand and the continuous load-relieving process aid strand into the knitting machine. A serving machine/overwrapping machine may be used to wrap the ceramic fiber strand around the continuous load-relieving process aid strand. Although knitting may be performed by hand, the commercial manufacture of knit components is generally performed by knitting machines. Any suitable knitting machine may be used. The knitting machine may be a single double-flatbed knitting machine.

In some implementations where the multi-component stranded yarn may further comprises a metal alloy wire the bi-component yarn may be fed through a first material feeder (e.g., 704A in FIG. 7) and the metal alloy wire may be simultaneously fed through a second material feeder (e.g., 704B in FIG. 7) to form the knit fabric. The strands may be concurrently knit to form a single layer.

At block 620, in some implementations where the process aid is a sacrificial process aid, the knit fabric is exposed to a process aid removal process. Depending upon the material of the process aid, the process aid removal process may involve exposing the knit fabric to solvents, heat and/or light. In some implementations where the process aid is removed via exposure to heat (e.g., heat fugitive), the knit fabric may be heated to a first temperature to remove the load-relieving process aid. It should be understood that the temperatures used for process aid removal process are material dependent.

Optionally, at block 630, the knit fabric is exposed to a strengthening heat treatment process. The knit fabric may be heated to a second temperature greater than the first temperature to anneal the ceramic strand. Annealing the ceramic strand may relax the residual stresses of the ceramic strand allowing for higher applied stresses before failure of the ceramic fibers. Elevating the temperature above the first temperature of the heat clean may be used to strengthen the ceramic and also simultaneously strengthen the metal wire if present. After elevating the temperature above the first temperature, the temperature may then be reduced and held at various temperatures for a period of time in a step down tempering process. It should be understood that the temperatures used for the strengthening heat treatment process are material dependent.

In one exemplary implementation where the process aid is Nylon 6,6, the ceramic strand is Nextel™ 312, and the metal alloy wire is INCONEL® 718, after knitting, the knit fabric is exposed to a heat treatment process to heat clean/burn off the Nylon 6,6 process aid. Once the Nylon 6,6 process aid is removed, a strengthening heat treatment that both INCONEL® 718 and Nextel™ 312 can withstand is performed. For example, while heating the material to 1,000 degrees Celsius the Nylon 6,6 process aid burns off at a first temperature less than 1,000 degrees Celsius. The temperature is reduced from 1,000 degrees Celsius to about 700 to 800 degrees Celsius where the temperature is maintained for a period of time and down to 600 degrees Celsius for a period of time. Thus simultaneously annealing the Nextel™ 312 ceramic while grain growth and recrystallization of the INCONEL® 718 wire occurs. Thus simultaneous strengthening of the metal wire and subsequent heat treatment of the ceramic are achieved.

At block 640, the knit fabric may be impregnated with a selected settable impregnate which is then set. The knit fabric may be laid up into a perform or fit into a mandrel prior to impregnation with the selected settable impregnate. Suitable settable impregnates include any settable impregnate that is compatible with the knit fabric. Exemplary suitable settable impregnates include organic or inorganic plastics and other settable moldable substances, including glass, organic polymers, natural and synthetic rubbers and resins. The knit fabric may be infused with the settable impregnate using any suitable liquid-molding process known in the art. The infused knit fabric may then be cured with the application of heat and/or pressure to harden the knit fabric into the final molded product.

One or more filler materials may also be incorporated into the knit fabric depending upon the desired properties of the final knit product. The one or more filler materials may be fluid resistant. The one or more filler materials may be heat resistant. Exemplary filler material include common filler particles such as carbon black, mica, clays such as e.g., montmorillonite clays, silicates, glass fiber, carbon fiber, and the like, and combinations thereof.

Figure 7:
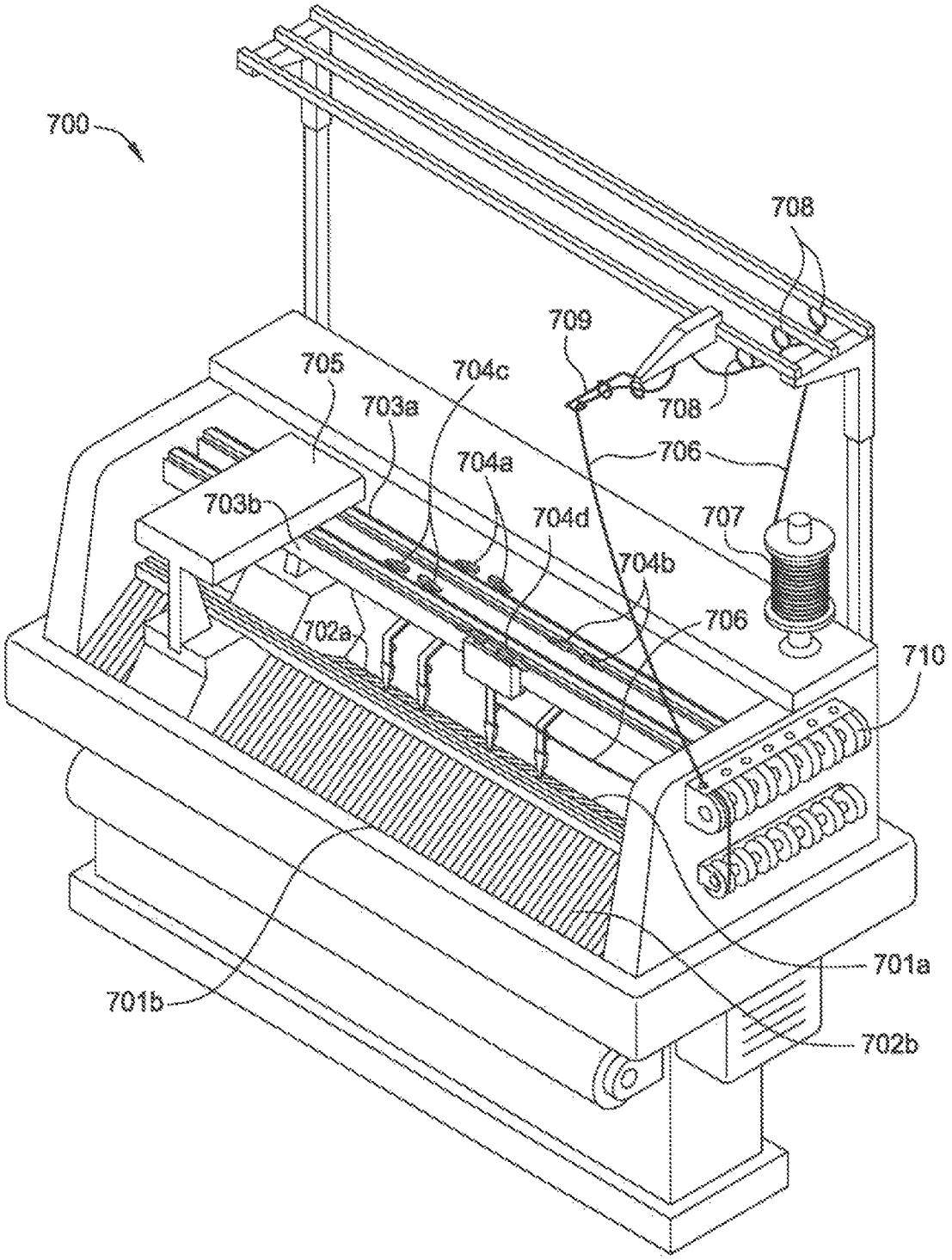
FIG. 7 is a perspective view of an exemplary knitting machine that may be used according to implementations described herein.

FIG. 7 is a perspective view of an exemplary knitting machine that may be used according to implementations described herein. Although knitting may be performed by hand, the commercial manufacture of knit components is generally performed by knitting machines. The knitting machine may be a single double-flatbed knitting machine. An example of a knitting machine 700 that is suitable for producing any of the knit components described herein is depicted in FIG. 7. Knitting machine 700 has a configuration of a V-bed flat knitting machine for purposes of example, but any of the knit components or aspects of the knit components described herein may be produced on other types of knitting machines.

Knitting machine 700 includes two needle beds 701*a*, 701*b* (collectively 701) that are angled with respect to each other, thereby forming a V-bed. Each of needle beds 701*a*, 701*b* include a plurality of individual needles 702*a*, 702*b* (collectively 702) that lay on a common plane. That is, needles 702*a* from one needle bed 701*a* lay on a first plane, and needles 702*b* from the other needle bed 701*b* lay on a second plane. The first plane and the second plane (i.e., the two needle beds 701) are angled relative to each other and meet to form an intersection that extends along a majority of a width of knitting machine 700. Needles 702 each have a first position where they are retracted and a second position where they are extended. In the first position, needles 702 are spaced from the intersection where the first plane and the second plane meet. In the second position, however, needles 702 pass through the intersection where the first plane and the second plane meet.

A pair of rails 703*a*, 703*b* (collectively 703) extends above and parallel to the intersection of needle beds 701 and provide attachment points for multiple standard feeders 704*a-d* (collectively 704). Each rail 703 has two sides, each of which accommodates one standard feeder 704. As such, knitting machine 700 may include a total of four feeders 704*a-d*. As depicted, the forward-most rail 703*b* includes two standard feeders 704*c*, 704*d* on opposite sides, and the rearward-most rail 703*a* includes two standard feeders 704*a*, 704*b* on opposite sides. Although two rails 703*a*, 703*b* are depicted, further configurations of knitting machine 700 may incorporate additional rails 703 to provide attachment points for more feeders 704.

Due to the action of a carriage 705, feeders 704 move along rails 703 and needle beds 701, thereby supplying yarns to needles 702. In FIG. 7, a yarn 706 is provided to feeder 704*d* by a spool 707 through various yarn guides 708, a yarn take-back spring 709 and a yarn tensioner 710 before entering the feeder 704*d* for knitting action. The yarn 706 may be any of the multi-component stranded yarns previously described herein. While individual or bi-component material strands may be wrapped into multi-component yarns 706 and packaged onto spools 707, separately packaged yarns (these additional spools are not depicted) may be combined at the yarn tensioner 710 so they both enter the feeder 704*d* together.

When yarn 706 incorporates a load bearing strand and a ceramic strand that serves the load bearing strand as previously described above, the load bearing strand may carry a greater load fraction of the yarn 706 than the ceramic strand as the yarn 706 exits the small radius feeder tip of the standard feeders 704. Thus, the ceramic strand is not subjected to as great a load or as tight a bending radius as it exits the feeder tip of the standard feeders 704.

Fabrication and qualification tests performed on samples based on the implementations described herein demonstrated increased performance over current baselines, including compression set, abrasion, and fire/flame tests on integrated Nextel™ 312 ceramic fiber and INCONEL® alloy 718 and P-Seal samples. Multi-layer current state of the art thermal barrier seals were compared with the integrated knit ceramic (Nextel™ 312) and metal alloy (INCONEL® alloy 718) seals formed according to implementations described herein. The integrated knit ceramic seals employed a co-knit Nextel™ 312 and small diameter INC- ONEL® alloy 718 wire along with a larger diameter INCONEL® alloy 718 wire inlay.

Compression set testing was performed at 800 degrees Fahrenheit for 220 hours. All samples had less than 1% height deflection post-test. Under the same compression set testing conditions, the current state of the art barrier seal became plastically compressed resulting in gaps and ultimately failure as a thermal and flame barrier. No failures occurred during initial abrasion testing with 5,000 cycles at 30% compression. The backside of the seal remained intact under 200 degrees Fahrenheit when a 3,000 degrees Fahrenheit torch was applied to the front at a one inch offset from the seal for a period of five minutes. No failures occurred under fire testing with a flame at 2,000 degrees Fahrenheit for a period of 15 minutes. Furthermore, no flame penetration was observed during testing and no backside burning occurred when the flame was shut off after a period of 15 minutes.

It should be noted that the products constructed with the implementations described herein are suitable for use in a variety of applications, regardless of the sizes and lengths required. For example, the implementations described herein could be used in automotive, marine, industrial, aeronautical or aerospace applications, or any other application wherein knit products are desired to protect nearby components from exposure to volatile fluids and thermal conditions.

While the foregoing is directed to implementations of the present disclosure, other and further implementations of the disclosure may be devised without departing from the basic scope thereof, and the scope thereof is determined by the claims that follow.

What is claimed is:

1. A method for knitting a ceramic fabric, comprising:

wrapping a continuous ceramic strand around a continuous load-relieving process aid strand;

simultaneously feeding the continuous ceramic strand and the continuous load-relieving process aid strand wrapped therearound into a knitting machine through a single material feeder to form a bi-component yarn;

simultaneously feeding the bi-component yam and a metal alloy wire through a second material feeder to form a knit fabric.

2. The method of claim 1, further comprising:

heating the knit fabric to a first temperature to remove the continuous load-relieving process aid strand.

3. The method of claim 2, further comprising:

heating the knit fabric to a second temperature greater than the first temperature to anneal the continuous ceramic strand.

4. The method of claim 1, wherein the continuous ceramic strand comprises one or more individual ceramic filaments having a diameter of about 15 micrometers or less.

5. The method of claim 1, wherein the continuous ceramic strand withstands a small radius bend of less than 0.07 inches without breakage.

6. The method of claim 1, wherein the continuous load-relieving process aid strand is a monofilament.

7. The method of claim 6, wherein the continuous load-relieving process aid strand comprises a diameter of about 150 micrometers to about 250 micrometers.

8. The method of claim 6, wherein the continuous load-relieving process aid strand is heated to a temperature of 500 degrees Celsius or higher.

9. The method of claim 1, wherein the continuous ceramic strand is resistant to a temperature of 1200 degrees Celsius or higher.

10. The method of claim 1, wherein the continuous load-relieving process aid strand is a metallic material selected from the group consisting of aluminum, stainless steel, copper, tin, and nickel-plated copper.

11. The method of claim 1, wherein forming the bi-component yarn comprises wrapping the continuous ceramic strand around the continuous load-relieving process aid strand a number of wraps per unit length of about 0.3 to 3 wraps per inch.

12. A method for knitting a ceramic fabric, comprising:

forming a bi-component yarn by wrapping a continuous ceramic strand around a continuous load-relieving process aid strand a number of wraps per unit length of about 0.3 to 3 wraps per inch; then simultaneously feeding the continuous ceramic strand and the continuous load-relieving process aid strand into a knitting machine through a single material feeder.

13. The method of claim 12, wherein the continuous ceramic strand is wrapped around the continuous load-relieving process aid strand in a single direction.

14. The method of claim 12, wherein the continuous ceramic strand is wrapped around the continuous load-relieving process aid strand in two directions.

15. The method of claim 12, wherein the continuous load-relieving process aid strand comprises a polymeric monofilament.

16. The method of claim 15, wherein the continuous load-relieving process aid strand comprises a diameter of about 150 micrometers to about 250 micrometers.

17. The method of claim 12, wherein the continuous load-relieving process aid strand is heated to a temperature of 500 degrees Celsius or higher.

18. The method of claim 11, wherein the continuous ceramic strand is resistant to a temperature of 1200 degrees Celsius or higher.

19. The method of claim 11, wherein the continuous load-relieving process aid strand is a metallic material selected from the group consisting of aluminum, stainless steel, copper, tin, and nickel-plated copper.

20. A method for knitting a ceramic fabric, comprising:

simultaneously feeding a continuous ceramic strand and a continuous load-relieving process aid strand into a knitting machine through a single material feeder to form a bi-component yarn, wherein the continuous ceramic strand withstands a small radius bend of less than 0.07 inches without breakage, is resistant to a temperature of 1200 degrees Celsius or higher, and comprises one or more individual ceramic filaments having a diameter of about 15 micrometers or less, the continuous load-relieving process aid strand comprises a diameter of about 150 micrometers to about 250 micrometers and is a metallic material selected from the group consisting of aluminum, stainless steel, copper, tin, and nickel-plated copper, and forming the bi-component yarn comprises wrapping the continuous ceramic strand around the continuous load-relieving process aid strand a number of wraps per unit length of about 0.3 to 3 wraps per inch; and then simultaneously feeding the bi-component yarn and a metal wire through a second material feeder to form a knit fabric.

21. The method of claim 20, wherein the metal wire is a monofilament.

22. The method of claim 21, wherein the metal wire is multifilament.

23. A method for knitting a ceramic fabric, comprising:

simultaneously feeding a continuous ceramic strand and a continuous load-relieving process aid strand into a knitting machine through a single material feeder to form a bi-component yarn;

simultaneously feeding the bi-component yarn and a metal alloy wire through a second material feeder to form a knit fabric;

heating the knit fabric to a first temperature to remove the continuous load-relieving process aid strand; and heating the knit fabric to a second temperature greater than the first temperature to anneal the continuous ceramic strand.

* * * * *